US010364055B2

(12) United States Patent
Izquierdo Ereño et al.

(10) Patent No.: US 10,364,055 B2
(45) Date of Patent: Jul. 30, 2019

(54) PACKAGING MACHINE AND METHOD

(71) Applicant: ULMA PACKAGING TECHNOLOGICAL CENTER. S.COOP, Oñati (ES)

(72) Inventors: Eneko Izquierdo Ereño, Oñati (ES); Nicolas Arregi Arambarri, Oñati (ES); Nerea Arbulu Ormaechea, Oñati (ES)

(73) Assignee: ULMA PACKAGING TECHNOLOGICAL CENTER S. COOP., Onati (ES)

( * ) Notice: Subject to any disclaimer, the term of this patent is extended or adjusted under 35 U.S.C. 154(b) by 577 days.

(21) Appl. No.: 15/004,158

(22) Filed: Jan. 22, 2016

(65) Prior Publication Data

US 2016/0159507 A1 Jun. 9, 2016

Related U.S. Application Data

(63) Continuation of application No. PCT/EP2014/065588, filed on Jul. 21, 2014.

(30) Foreign Application Priority Data

Jul. 24, 2013 (ES) ..... 201331133

(51) Int. Cl.
*B65B 31/04* (2006.01)
*B65B 11/52* (2006.01)
(Continued)

(52) U.S. Cl.
CPC ..... *B65B 31/046* (2013.01); *B65B 9/04* (2013.01); *B65B 9/045* (2013.01); *B65B 11/52* (2013.01);
(Continued)

(58) Field of Classification Search
CPC ..... B65B 11/52; B65B 11/50; B65B 2220/22; B65B 31/02; B65B 31/021; B65B 31/04; B65B 31/041; B65B 31/043; B65B 31/046
(Continued)

(56) References Cited

U.S. PATENT DOCUMENTS 2,970,414 A 2/1961 Rohdin
3,238,691 A 3/1966 Miller et al.
(Continued)

FOREIGN PATENT DOCUMENTS

DE 59984 1/1968
DE 1511634 A 8/1970
(Continued)

OTHER PUBLICATIONS

International Search Report in corresponding International Application No. PCT/EP2014/065588, completed on Oct. 14, 2014.
(Continued)

*Primary Examiner* — Hemant Desai
*Assistant Examiner* — Valentin Neacsu
(74) *Attorney, Agent, or Firm* — Edell, Shapiro & Finnan, LLC

(57) ABSTRACT

A modified atmosphere, skin or vacuum packaging machine comprising first feed means adapted for feeding a first film to the machine, second feed means adapted for feeding a second film to the machine, and a sealing station where the vacuum is formed and/or the modified atmosphere is introduced, and the second film is sealed to the first film to obtain a package. The machine comprises displacement means configured for moving at least the first film a driving distance from an initial position, holding down and driving at least the first film in the driving direction to an end position, said displacement means being configured for
(Continued)

subsequently returning to the initial position when the machine is in operating mode.

10 Claims, 6 Drawing Sheets

(51) Int. Cl.

| | |
|---|---|
| ***B65B 31/02*** | (2006.01) |
| ***B65B 9/04*** | (2006.01) |
| ***B65B 47/06*** | (2006.01) |
| ***B65B 57/04*** | (2006.01) |
| ***B65B 61/06*** | (2006.01) |
| ***B65B 47/04*** | (2006.01) |

(52) U.S. Cl.
CPC ..... *B65B 31/021* (2013.01); *B65B 47/04* (2013.01); *B65B 47/06* (2013.01); *B65B 57/04* (2013.01); *B65B 61/065* (2013.01); *B65B 2220/22* (2013.01)

(58) Field of Classification Search
USPC ..... 53/511, 553, 555, 559, 561
See application file for complete search history.

(56) References Cited

U.S. PATENT DOCUMENTS

| | | | | |
|---|---|---|---|---|
| 3,795,080 | A | 3/1974 | Smolderen et al. | |
| 3,832,821 | A * | 9/1974 | Walus | B65B 11/52 53/140 |
| 4,253,364 | A | 3/1981 | Guenther et al. | |
| 4,779,398 | A | 10/1988 | Glandon et al. | |
| 6,769,231 | B2 * | 8/2004 | Danby | A21B 7/00 222/105 |
| 8,474,226 | B2 * | 7/2013 | Izquierdo | B65B 9/045 493/11 |
| 2005/0173289 | A1 * | 8/2005 | Natterer | B65B 9/04 206/524.8 |
| 2005/0252351 | A1 * | 11/2005 | Natterer | B65B 9/04 83/39 |
| 2006/0230708 | A1 * | 10/2006 | Granili | B65B 9/045 53/427 |
| 2007/0220833 | A1 | 9/2007 | Freddi | |
| 2009/0301920 | A1 * | 12/2009 | Oses Fisac | A61L 2/206 206/459.5 |
| 2010/0287881 | A1 * | 11/2010 | Ehrmann | B65B 7/164 53/170 |
| 2011/0023421 | A1 * | 2/2011 | Izquierdo | B65B 9/045 53/477 |
| 2012/0045558 | A1 * | 2/2012 | Fanfani | B32B 27/32 426/396 |
| 2013/0206913 | A1 * | 8/2013 | Stevenson | A01C 1/042 244/137.1 |
| 2014/0033647 | A1 * | 2/2014 | Izquierdo Ereno | B65B 11/58 53/218 |
| 2014/0190125 | A1 * | 7/2014 | Rearick | B65B 25/04 53/434 |
| 2016/0176598 | A1 * | 6/2016 | Palumbo | B65D 81/2038 206/497 |

FOREIGN PATENT DOCUMENTS

| | | | |
|---|---|---|---|
| DE | 2152910 | A | 5/1972 |
| DE | 2235280 | A1 | 1/1974 |
| DE | 2832365 | A1 | 1/1980 |
| DE | 4017923 | C1 | 2/1991 |
| DE | 102004024358 | A1 | 12/2005 |
| DE | 102006033782 | A1 | 1/2008 |
| DE | 102007047058 | A1 | 4/2008 |
| DE | 2226456 | A | 9/2010 |
| EP | 0217362 | A1 | 4/1987 |
| EP | 0436476 | B1 | 8/1993 |
| EP | 0571679 | | 12/1993 |
| EP | 2228327 | A1 | 9/2010 |
| EP | 2281749 | | 2/2011 |
| GB | 967729 | | 8/1964 |
| GB | 1552299 | | 9/1979 |
| GB | 2184086 | | 6/1987 |

OTHER PUBLICATIONS

Article "Modified Atmosphere" at en.wikipedia.org in the version of Apr. 14, 2013.
Article "Skin pack" at en.wikipedia.org in the version of Mar. 15, 2013.
Collection of exhibits establishing obvious prior use of an R 550 machine.
Notice of Opposition to European Patent No. 3,024,733 B1 dated Feb. 8, 2019, 48 pages.
Article "Vacuum Packing" at en.wikipedia.org in the version of Jul. 10, 2013.

* cited by examiner

PACKAGING MACHINE AND METHOD

CROSS-REFERENCE TO RELATED APPLICATIONS

This application relates to and claims the benefit and priority to International Application NO. PCT/EP2014/065588, filed Jul. 21, 2014, which claims the benefit and priority to Spanish Patent Application No. P201331133, filed Jul. 24, 2013.

TECHNICAL FIELD

The present invention relates to a method and a machine, particularly a forming machine adapted for packaging products in a modified atmosphere (also known as MAP packaging), vacuum packaging products in a type of skin (also known as skin packaging) or vacuum packaging products.

BACKGROUND

Vacuum or modified atmosphere packaging methods and packaging machines are known.

Known packaging machines comprise first film feed means, a thermoforming station where containers are made in the first film inside which the product to be packaged will be introduced in a later step, second film feed means, and a sealing station that is supplied with both films and where the vacuum is formed or the gas is introduced in the container containing the product to be packaged. Subsequently in the sealing station, the second film is sealed to the first film such that the package is obtained. In a later step, cutting means comprised in the machine cuts the films longitudinally and transversely, separating the packages that have been formed.

Generally, as described in US2005/0173289A1, a packaging machine of this type comprises chains guiding the movement of the first film, said first film being fixed to said chains laterally, such that it remains taut.

SUMMARY OF THE DISCLOSURE

The modified atmosphere or vacuum packaging machine comprises a first film feed assembly/first feed means adapted for feeding a first film to the machine, a second film feed assembly/second feed means adapted for feeding a second film to the machine, a sealing station where the vacuum is formed and/or the modified atmosphere is introduced between both films and the second film is sealed to the first film to obtain a package, and a displacement assembly/displacement means adapted for moving the first film in a driving direction.

The displacement assembly/displacement means is configured for moving at least the first film a driving distance from an initial position, holding down and driving at least the first film in the driving direction to an end position, said displacement assembly being configured for subsequently returning to the initial position when the machine is in operating mode.

In addition, the modified atmosphere, skin or vacuum packaging method comprises the following steps:

- feeding a first film to the machine through first feed means,
- positioning a second film on the first film after placing the product to be packaged on the first film,
- forming a vacuum and/or introducing the modified atmosphere between both films, The displacement assembly holds down and drives the first film a driving distance from an initial position to an end position through the preceding steps when the machine is in displacement mode, subsequently returning to the initial position when the machine is in the operating mode.

A packaging machine and method that can reduce film waste produced during the packaging process to a minimum are obtained. Both the method and the machine are more efficient and at the same time cleaner than any known in the state of the art because they produce virtually no discarded film, using almost all the film. A packaging machine and a packaging method that have less of an impact on the environment are obtained. Furthermore, it allows filling many type of skin package, including those packages containing a product that projects above said package.

These and other advantages and features will become evident in view of the drawings and the detailed description.

DETAILED DESCRIPTION

The packaging machine 1 according to the invention can be a modified atmosphere packaging machine, also known as a MAP packaging machine, which wraps the product to be packaged in a mixture of gases in the package, such that said mixture meets the specific ventilation needs of the packaged product, or it can be a vacuum packaging machine, or a skin packaging machine, being able to package both products whose height is less than the height of a tray where the product is placed and products projecting above the tray.

Figure 1:
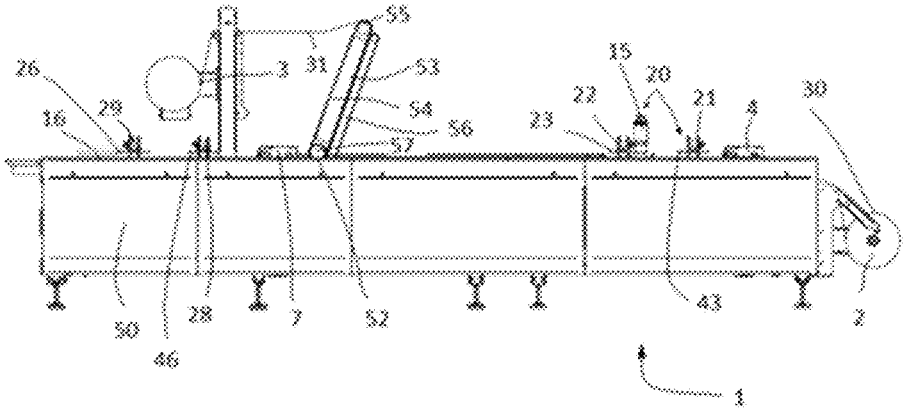
FIG. 1 shows a side view of a skin packaging machine according to one embodiment.
Figure 2:
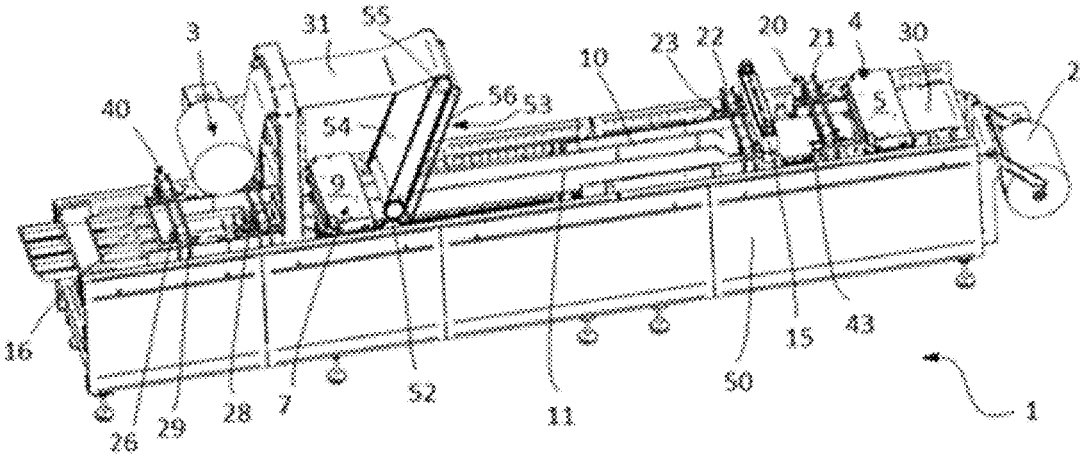
FIG. 2 shows a perspective view of the packaging machine shown in FIG. 1.
Figure 3:
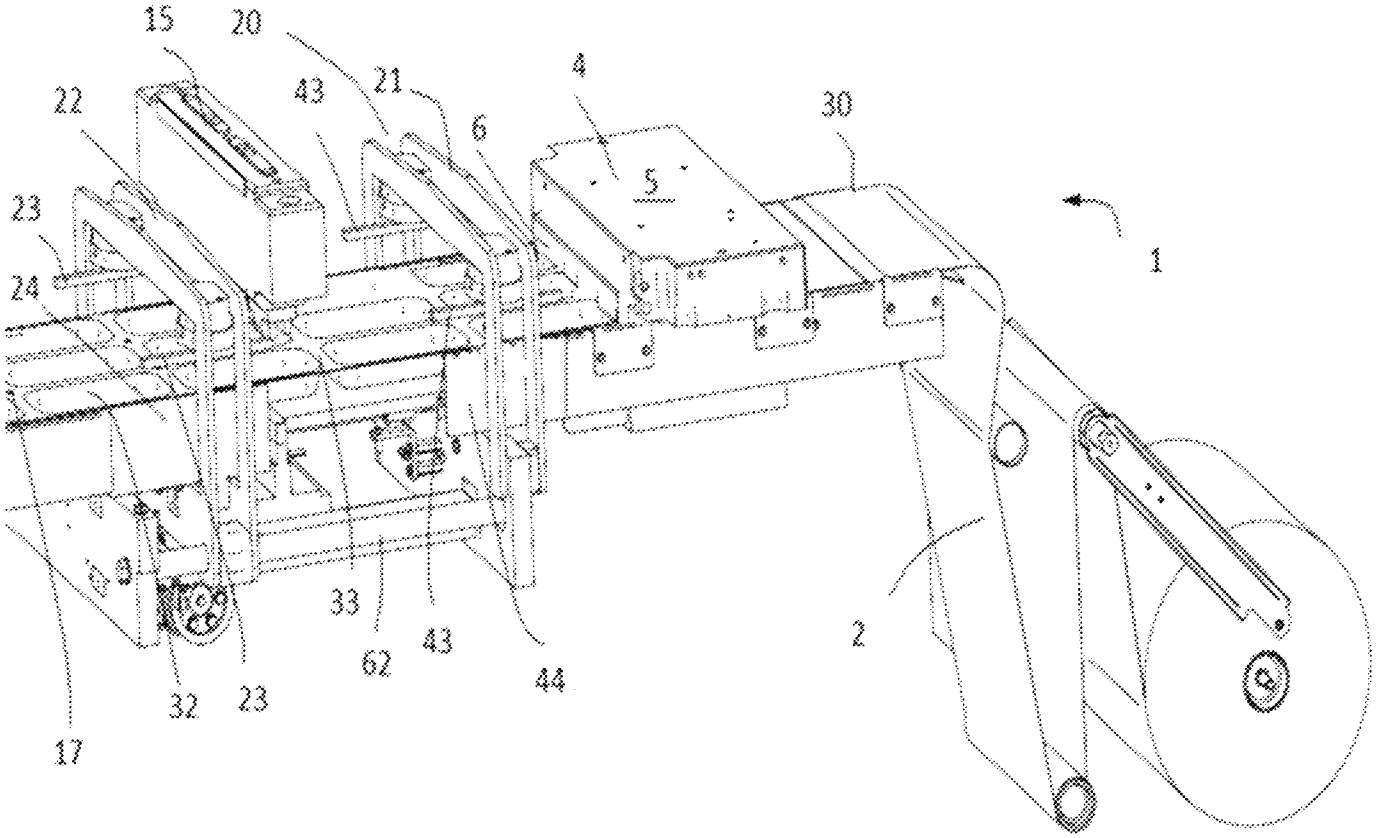
FIG. 3 shows a detailed view of the machine shown in FIG. 1, in which a forming station and displacement means of the machine are shown in detail.

FIG.1 schematically shows a skin packaging machine 1 according to one embodiment. The machine 1 comprises a first film feed assembly/first feed means 2 adapted for feeding a first film 30 to the machine 1, a thermoforming station 4 where at least one container 32 is made in the first film 30 inside which the product to be packaged is introduced in a filling station, a second film feed assembly/second feed means 3 adapted for feeding a second film 31 to the packaging machine 1, and a sealing station 7 where a vacuum is formed and the second film 31 is sealed to the first film 30 to obtain a package 34. The vacuum allows adjusting the second film 31 to the shape of the product placed in the formed area 32, obtaining a skin-type package 34.

In addition, one embodiment of the skin packaging method comprises the following steps:

feeding the first film 30 to the machine 1 through the first feed means 2, positioning the second film 31 on the first film 30 after placing the product to be packaged on the first film 30, forming the vacuum between both films 30 and 31, sealing both films 30 and 31 to obtain the package 34, and separating the package 34.

Figure 6A:
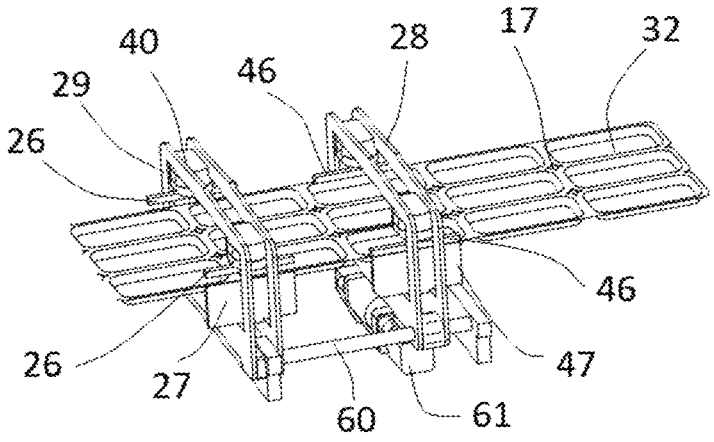
FIGS. 6A and 6B show isometric views of the second displacement assembly of FIG. 4 showing the various positions of the moveable support and hold-plates when the packaging machine is in displacement mode.
Figure 6B:
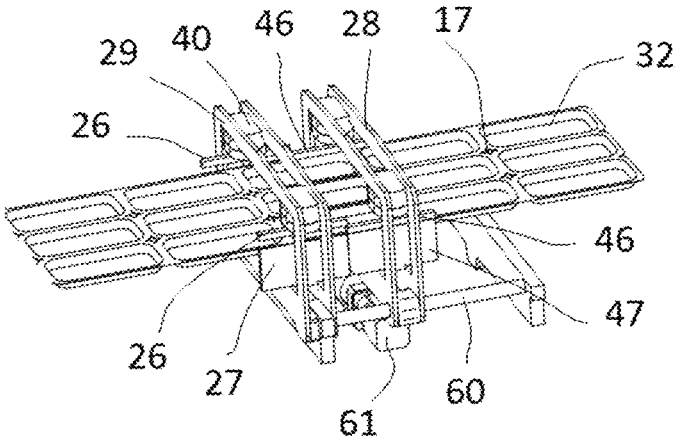
Figure 6C:
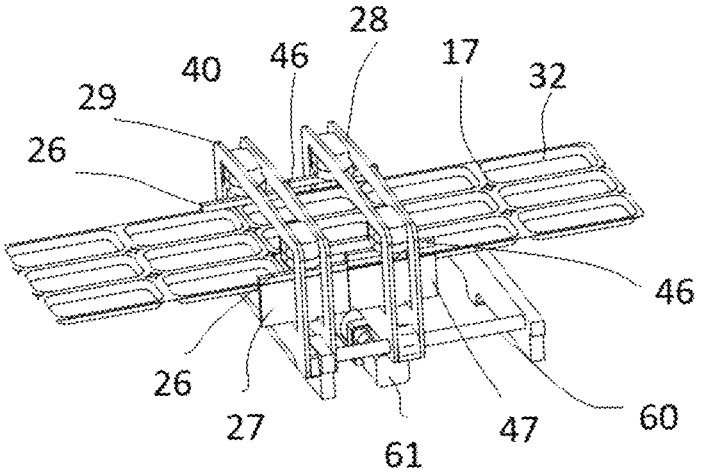
FIGS. 6C and 6D show isometric views of the second displacement assembly of FIG. 4 showing the various positions of the moveable support and hold-down plates when the packaging machine is in operating mode.
Figure 6D:
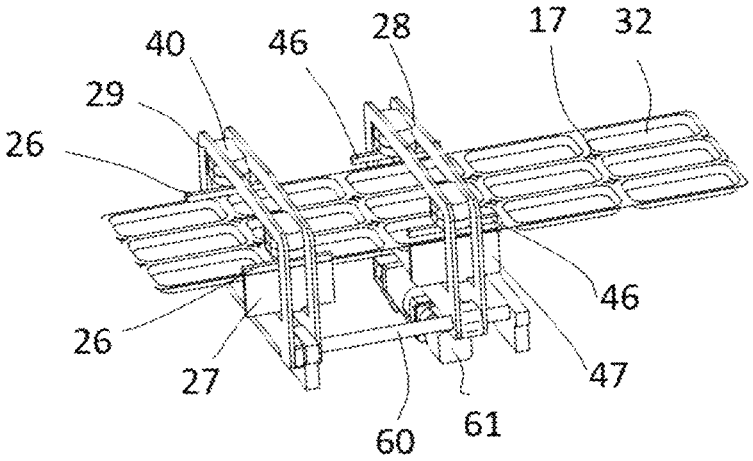

When the machine 1 is in any of the preceding steps, it is in the operating mode where the displacement means 20 and 40 act to hold down the first film 30, retaining it in a fixed position by use of a first set of hold-down plates as will be described in detail below. When the machine is in displacement mode, the displacement means 20 and 40 hold down the first film 30 by use of a second set of hold-down plates while pulling the film 30 in the driving direction a driving distance to an end position. At said end position, the displacement means 20 and 40 immobilize the first film 30 by use of the first set of hold-down plates while the displacement means 20 and 40 return to the initial position. FIGS. 6A and 6B show the second displacement means when the packaging machine 1 is in the displacement mode. FIGS. 6C and 6D show the second displacement means when the packaging machine 1 is in the displacement mode.

According to one embodiment the feed means 2 comprises at least one reel and unwinding means driving the first film 30 to the thermoforming station 4. Said feed means 2 is known in the state of the art so it will not be described below.

In addition, films 30 and 31 can be made of any type of plastic known for MAP, vacuum or skin packaging applications.

In addition, according to one embodiment the thermoforming station 4 comprises a male mold 5 and a female mold 6 adapted for obtaining the geometric shape of the container 32 and heating means not depicted in the drawings that heats the first film 30 in order to carry out the thermoforming process. Other thermoforming stations known in the state of the art, for example vacuum or pressure thermoforming stations, can be used in other embodiments. Containers 32, also known as trays, are formed in the first film 30 in the thermoforming station 4, and are then separated from one another in areas referred to as non-formed areas 33.

If a single package 34 is going to be made, a single container 32 will be formed in the first film 30, the non-formed area 33 being the area on the perimeter of said container 32. Said non-formed area 33 will make up the border 35 of the package 34 that is obtained. If a plurality of packages 34 is going to be made, a plurality of containers 32 surrounded by non-formed areas 33 which will respectively form the border 35 of the corresponding package 34 that is obtained will be formed in the thermoforming station 4, reducing waste to a minimum in the first film 30.

In other non-depicted embodiments, the machine 1 may not include a thermoforming station. In said cases, the product to be packaged rests directly on the first film 30 or on a base that is arranged on said first film 30 and on which the product is supported.

As noted above, the machine 1 comprises displacement means 20 and 40 adapted for moving the first film 30 in the driving direction.

Once the containers 32 are formed in the first film 30, said first film 30 is moved by a first displacement assembly/first displacement means 20 in the driving direction to a filling station where the product to be packaged is placed on each container 32. Said filling can be done either manually or automatically.

The first film 30, now formed as one or more containers 32, is then moved by the second displacement means 40 to the sealing station 7. At the same time, the second feed means 3 feeds the second film 31 to said sealing station 7. Said sealing station 7 comprises a top mold 8, a bottom mold 9, heating means (not depicted in the drawings) adapted for heating the top mold 8, vacuum means (not depicted in the drawings) adapted for creating the vacuum, and aeration means (no shown in the drawings) acting on the top mold 8. When the second film 31 enters the sealing station 7, a vacuum is applied to the top mold 8 such that said second film 31 is deformed towards the top mold 8 (which is previously heated), where said second film 31 is heated. At the same time, the first film 30 is positioned on the bottom mold 9. A vacuum is applied from the bottom mold 9, and then it is aerated from the top mold 8 such that the second film 31 is sealed to the first film 30 along the entire contact surface, deforming said second film 31 due to the effect of heating and adapting to the shape of the product placed in the container 32, such that a plurality of packages 34 are formed, that is, as many packages 34 are formed as containers 32 were made in the thermoforming station 4, such containers 34 being fixed to one another through the non-formed areas 33 corresponding with the border 35 of the package 34. In a later step, said packages 34 are separated from one another through the borders 35.

If the product to be packaged projects above the non-formed area 33 once the product is introduced, the second film 31 must be heated before being introduced in the sealing station 7 in order to adapt to the shape of the product to be packaged when it is positioned on the first film 30. To that end, the machine 1 further comprises a heating station where the second film 31 is heated before being introduced in the sealing station 7 to make the second film 31 more ductile. The machine 1 comprises auxiliary displacement means 53 keeping the second film 31 clamped as it moves through the heating station, preventing it from shrinking while it is heated. Said auxiliary displacement means 53 releases the second film 31 when it comes out of the heating station. Said release occurs close to the area where both films 30 and 31 come into contact with one another for the first time.

The machine 1 may further comprise pre-sealing means 52 arranged before the sealing station 7. Particularly, said pre-sealing means 52 is arranged where first contact between both films 30 and 31 occurs, i.e., where the second film 31 leaves the auxiliary displacement means 53. Said pre-sealing means 52 is adapted for sealing the second film 31 to the first film 30 longitudinally at discrete points. Sealing is preferably performed by heat sealing, although in other embodiments sealing may be performed by high-frequency welding or by other known sealing methods. Therefore, by keeping the films 30 and 31 aligned with one another by means of sealing at certain points from the moment both films 30 and 31 enter the sealing station, the second film 31 adapts to the product to be packaged better when products whose height exceeds the height of the corresponding container 32 are packaged. Once in the sealing station 7, the vacuum and sealing process is similar to that previously described.

In a one embodiment, the auxiliary displacement means 53 comprises a belt 54, guide rollers 55 moving the belt 54 and a counter-belt 56 holding the second film 31, clamping it against the belt 54. The belt 54 moves in synchronization with the displacement means 20 and 40 of the machine 1. Furthermore, the pre-sealing means 52 comprises a first gear wheel 57 coupled to a guide roller 55 of the auxiliary displacement means 53 and a second wheel 58 arranged below the first film 30. The second wheel 58 can be a gear wheel or a smooth welding roller. The first wheel 57 is arranged in the guide roller 55 arranged closest to the first film 30. The teeth of the first wheel 57 go through the belt 54 which has holes in it, being supported on the second wheel 58, thereby pressing the second film 31 against the first film 30. Said second wheel 58 is heated, both films 30 and 31 being welded to one another at discrete points as both wheels 57 and 58 rotate, moving both films 30 and 31 towards the sealing station 7.

In other embodiments, the auxiliary displacement means can comprise clamps which fix the taut second film 31 to the chain and gear wheels adapted for closing the clamps before entering the heating station and for opening said clamps after exiting the heating station. The clamps can be covered with a ductile material which holds the second film 31 without leaving marks.

As noted above, the pre-sealing means may comprise a gear wheel arranged below the first film 30 such that the teeth of the gear wheel of the auxiliary displacement means arranged closest to the first film 30 are supported on the respective teeth of the gear wheel arranged below the first film 30, thereby pressing the second film 31 against the first film 30, both films 30 and 31 being welded to one another at discrete points as both wheels rotate, moving both films 30 and 31 towards the sealing station 7.

In other embodiments, gear wheels are not necessary, the pre-sealing being performed as both films 30 and 31 move forward using any known conventional welding means.

In addition, between the thermoforming station 4 and the sealing station 7, the packaging machine 1 comprises a longitudinal support 10 for the first film 30.

In one embodiment, the longitudinal support 10 comprise at least one longitudinal guide 11 on which the first film 30 is supported. The first film 30 is supported on said longitudinal guide 11 on the non-formed area 33 comprised between two consecutive containers 32. For every N containers 32 formed in the first film 30 transverse to the forward movement, N+1 non-formed areas 33 arranged between two consecutive containers 32 are formed, therefore N+1 longitudinal guides being arranged fixed to a frame 50 of the machine 1 on which the first film 30 is supported.

In other embodiments, particularly when thermoforming a single package 34, the longitudinal support 10 comprises a bearing surface under the first film 30 on which a bottom of the container 32 is supported. The bearing surface can be a planar surface, for example a table, over which the first film 30 slides with the product placed in the containers 32. In other embodiments, the longitudinal support 10 comprises a set of transversely arranged rollers (not depicted in the drawings) forming the bearing surface over which the first film 30 slides with products with minimum friction. The set of rollers is generally necessary when the products to be packaged are heavy in order to prevent high friction during movement. In addition, for said longitudinal support 10 to adapt to any depth of the containers 32, the height of the bearing surfaces can be adjusted.

In other embodiments, the longitudinal support 10 can comprise both the longitudinal guides and the bearing surfaces.

In other embodiments, the longitudinal support 10 can comprise a retractable conveyor belt adapted for moving together with the first film 30 with the products introduced therein into the sealing station 7, the conveyor belt being able to go back out of the sealing station 7 once the first film 30 with the products therein is placed on it.

As noted above, the displacement assemblies/displacement means 20 and 40 are configured for retaining the first film 30 in a specific position when the machine 1 is in the operating mode. The displacement means 20 and 40 are also configured to drive the first film 30 in the driving direction when the machine 1 is in forward movement mode/displacement mode. Said displacement means 20 and 40 are configured for holding down and moving the first film 30 in displacement mode. In addition, the machine 1 is considered to be in the operating mode when it is performing a thermoforming, vacuum, sealing or cutting operation on the package.

In the embodiment shown in the drawings, the first displacement means 20 is arranged between the thermoforming station 4 and the sealing station 7, particularly between the thermoforming station 4 and the filling station, and the second displacement means 40 is arranged after the sealing station 7.

In the embodiment shown in the drawings, the first displacement means 20 comprises a first fixed support 22 arranged stationary with respect to the frame 50 of the machine 1 and at a location between the thermoforming station 4 and the sealing station 7. The second displacement means 40 comprises a second fixed support 29 arranged stationary with respect to the frame 50 of the machine 1 and at a location after the sealing station 7. The first displacement means 20 also includes a first movable support 21 movable in the driving direction with respect to the first fixed support 22. The second displacement means 40 also includes a second movable support 28 movable in the driving direction with respect to the second fixed support 29.

According to some embodiments, each of the fixed supports 22 and 29 has a substantially bridge-shaped geometry. Each of the fixed supports 22 and 29 respectively comprises a support 24 and 27 on which the first film 30 may be arranged. Fixed support 22 includes one or more hold-down plates 23 configured for pressing the first film 30 against the support 24. Likewise, fixed support 29 includes one or more hold-down plates 26 configured for pressing the first film 30 against the support 27. The hold-down plates 23 and 26 are configured to press the first film against the respective supports 24 and 27 to keep the first film 30 retained in the specific position when the machine 1 is in operating mode. Each hold-down plate 23 and 26 is arranged facing the corresponding support 24 and 27, the first film 30 being arranged between both.

According to some embodiments each of the movable support 21 and 28 has a substantially bridge-shaped geometry. Each of the movable supports 21 and 28 respectively comprises supports 44 and 47 on which the first film 30 may be arranged. Moveable support 21 includes one or more hold-down plates 43 configured for pressing the first film 30 against the support 44. Moveable support 28 includes one or more hold-down plates 46 configured for pressing the first film 30 against the support 47. The hold-down plates 43 and 46 are respectively arranged facing the corresponding support 44 and 47 with the first film 30 being arranged between both. According to one embodiment, each of the movable supports 21 and 28 comprises a vertical actuation drive (not depicted) acting on the corresponding hold-down plate 43 and 46, moving said hold-down plate 43 and 46 vertically with respect to the first film 30. Said drive may be a pneumatic cylinder.

Figure 4:
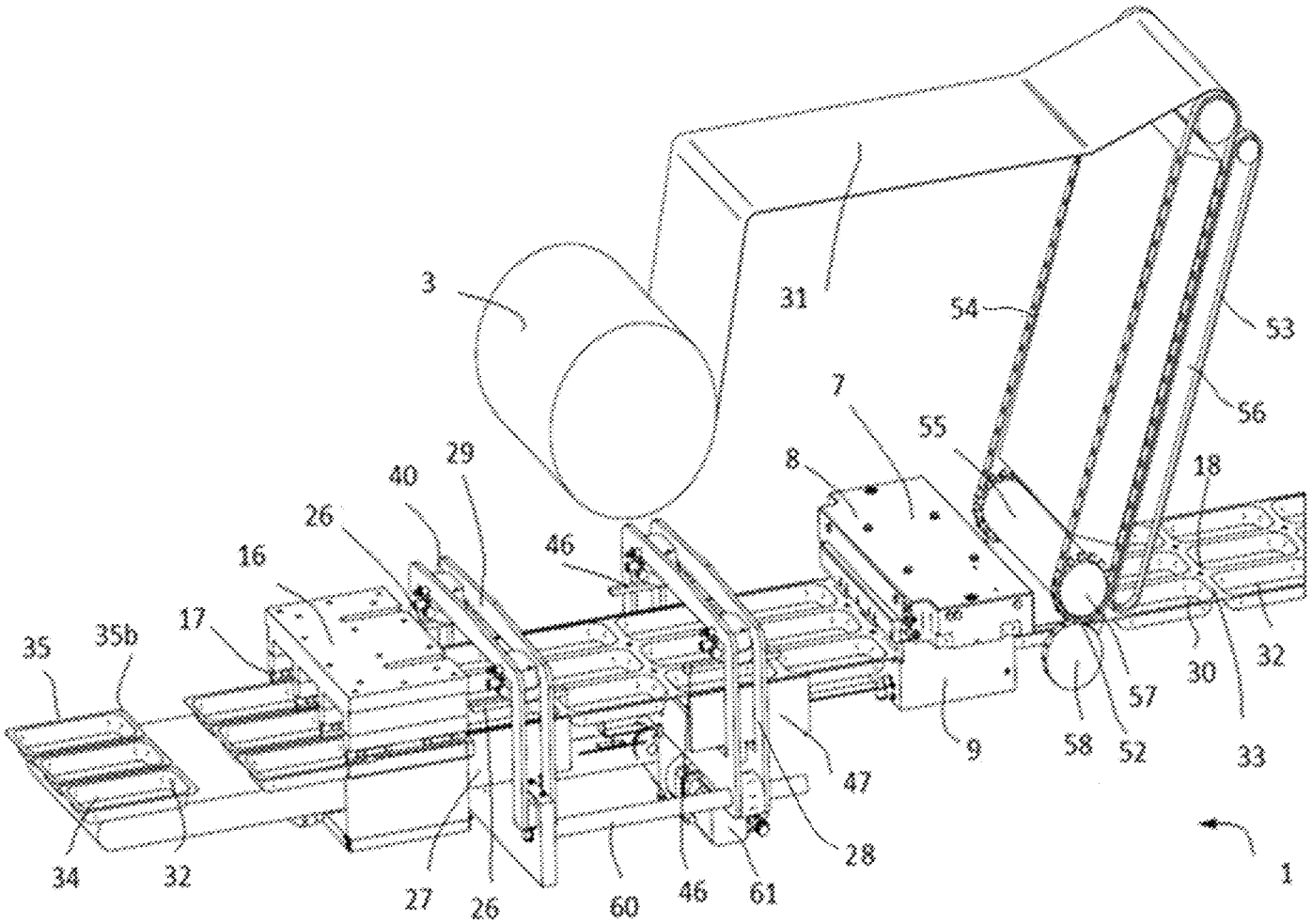
FIG. 4 shows a detailed view of the machine shown in FIG. 1, in which a pre-sealing station, a sealing station, cutting means and displacement means of the machine are shown in detail.
Figure 5:
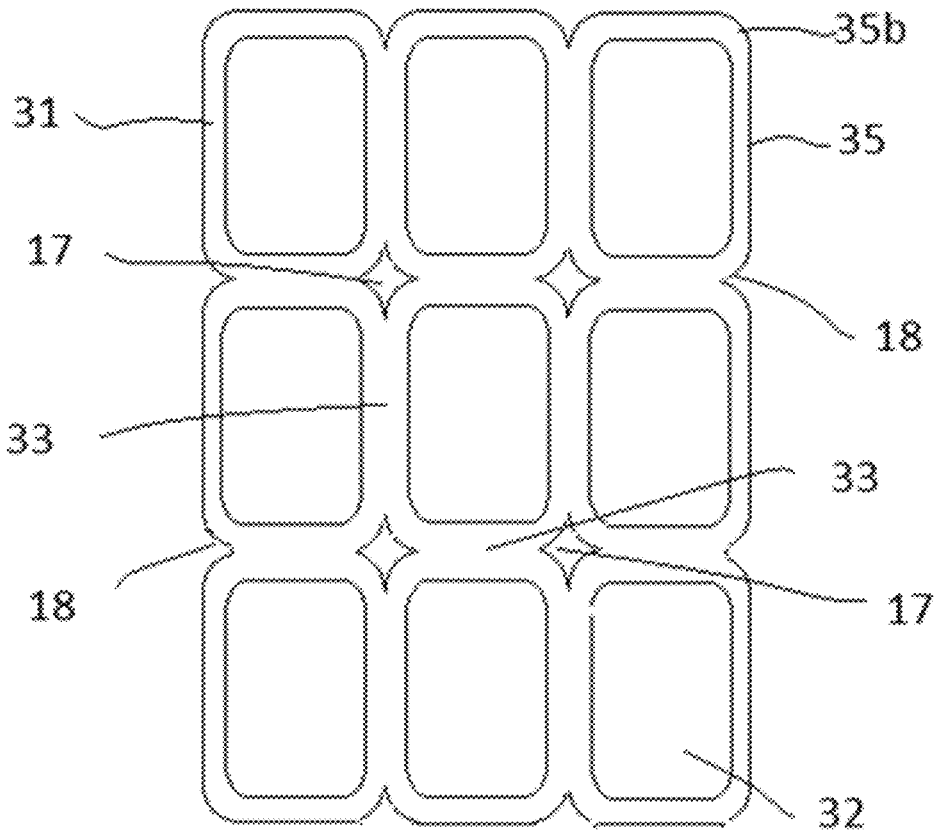
FIG. 5 shows a top view of a first film once it has gone through the thermoforming step and the punching step.

The displacement means 20 and 40 respectively comprise guides 62 and 60 and a longitudinal actuation drive acting on the corresponding movable supports 21 and 28, moving them in the driving direction through the guides. FIG. 4 shows the longitudinal actuation drive 61 associated with guide 60. Both the guides and the drive are arranged below the first film 30. The drive can be pneumatic, hydraulic or any other type known in the state of the art. The displacement means 20 and 40 act in a synchronized manner, moving the first film 30 forward intermittently. When the machine 1 operates in the operating mode, the movable supports 21 and 28 are arranged in the position furthest away from the fixed supports 22 and 29, the vertical drives corresponding to the hold-down plates 23 and 26 of the fixed supports 22 and 29 are activated, pressing the hold-down plates 23 and 26 against the first film 30, while the hold-down plates 43 and 46 of the movable supports 21 and 28 are not active and are therefore separated from the first film 30. The package thermoforming, sealing, vacuum and cutting operation will be performed in that position. FIGS. 6C and 6D show the positions of the moveable support 28 and hold-down plates 26 and 46 of the second displacement means 40 when the machine 1 is in the operating mode. In order to move the first film 30, once the operating mode ends, the vertical drives corresponding to the hold-down plates 43 and 46 of the movable supports 21 and 28 are activated, applying pressure on the first film 30 against the corresponding supports 44 and 47; the vertical drives corresponding to the hold-down plates 23 and 26 of the fixed supports 22 and 29 are deactivated said hold-down plates 23 and 26 being separated from the first film 30; and the longitudinal drives are activated, moving the movable supports 21 and 28 in the driving direction and therefore moving the first film 30 to the next position where the first film 30 is retained again. FIGS. 6A and 6B show the positions of the moveable support 28 and hold-down plates 26 and 46 of the second displacement means 40 when the machine 1 is in the displacement mode. When the movable supports 21 and 28 are arranged in the end position like that shown in FIGS. 6B and 6C, the vertical actuator corresponding to the hold-down plates 43 and 46 of the movable bearings 21 and 28 are deactivated, releasing the first film 30, while the vertical actuator corresponding to the hold-down plates 23 and 26 of the fixed supports 22 and 29 is activated, pressing said hold-down plates 23 and 26 against the corresponding supports, fixing the first film 30 in the end position. The movable supports 21 and 28 are moved by the corresponding longitudinal actuator 61 to the initial position, i.e., starting position as shown in FIGS. 6A and 6D, repeating the same forward movement cycle.

The hold-down plates 23, 26, 43 and 46 are supported on the non-formed areas 33 of the first film 30, not on the containers 32 where the product to be packaged will later be placed. In the embodiment shown in the drawings, the hold-down plates 23, 26, 43 and 46 have an elongated, flat bar-type geometry. Said hold-down plates 23, 26, 43 and 46 are longitudinally aligned, acting on the non-formed areas 33 comprised on the edges of the first film 30.

In other embodiments, the displacement means 20 and 40 may comprise a hold-down plate 23, 26, 43 and 46 arranged longitudinally acting on the non-formed areas 33. So for every N containers 32 transversely formed in the first film 30, N+1 non-formed areas 33 are formed, N+1 hold-down plates 23, 26, 43 and 46 therefore being arranged.

Furthermore, according to some embodiments, each of the hold-down plates 23, 26, 43 and 46 has a length substantially equal to the pitch of the machine 1, the pitch of the machine being understood as the distance that the first film 30 moves forward when the machine 1 is in the displacement mode, and a width substantially equal to the width of the corresponding non-formed area 33. If the non-formed area 33 corresponds to a non-formed area 33 between two consecutive containers 32, the width of the hold-down plate will be substantially twice that of the previous one.

In other embodiments, the hold-down plates 23, 26, 43 and 46 may be arranged transverse to the driving direction.

In other embodiments, the displacement means 20 and 40 can respectively be included in the thermoforming station and in the sealing station, such that the top and bottom molds of each station perform movable support functions, the hold-down plates are the top molds, while the bottom molds perform the support function.

In addition, the machine 1 may comprise punching means 15 adapted for punching the first film 30 in a non-formed area 33. The punching operation is performed before said first film 30 reaches the sealing station 7, particularly before the step of introducing the product in the container 32. In the embodiment shown in the drawings, the punching means 15 is comprised in the displacement means 20. According to such an embodiment the punching means 15 may comprise at least one punch coupled to the first fixed support 22 that is arranged stationary in relation to the frame 50 of the machine 1 between the thermoforming station 5 and the sealing station 7.

The punching means 15 is configured to produce at least one hole 17 and/or a notch 18 in the non-formed area 33. In one embodiment, the punching means 15 produces a notch 18 or a hole 17 at the intersection of the non-formed areas 33 when the machine 1 is in the operating mode. The notches 18 are made on the edges of the first film 30 while the holes 17 are made at the intersections of the inner non-formed areas 33. The geometry of the holes 17 and/or notches 18 is such that it forms rounded corners 35*b* on the border 35 of the package 34. In one embodiment, as shown in the drawings, each hole 17 has a rosette-shaped geometry made at the intersection of two non-formed areas 33 and each notch 18 has a half rosette-shaped geometry.

In one embodiment, the holes 17 are used for performing evacuation in the sealing station 7. The notches 18 further allow correctly positioning the second movable support 28, particularly the hold-down plates 46 of said second movable support 28, which allows moving the first film 30 forward a predetermined distance, such that it is positioned correctly inside the respective stations of the machine 1. To that end, the machine 1 may further comprise detection means (not depicted) configured for detecting the notches 18 and control means which position the displacement means 20 and 40 in the place indicated according to the detected values.

When thermoforming a single container 32, and therefore intermittently forming a single package 34, the punching means 15 only produces notches 18. Therefore, given that the non-formed areas 33 are held down during vacuum formation and sealing by the molds 8 and 9 of the sealing station 7, in order to form the vacuum, the bottom mold 9 includes side openings through which the vacuum is formed. Otherwise, the vacuum and sealing process is equal to that previously described. At the same time, excess pressure is applied from the top mold 8 such that the second film 31 is sealed to the first film 30 along the perimeter of the non-formed areas 33, deforming due to the effect of heating and adapting to the shape of the product.

In another embodiment the manufacturing method does not comprise the step of making holes 17 with the punching means 15. In this case, the second film 31 is sealed to the first film 30 longitudinally at discrete points by the pre-sealing means 52. Subsequently, in the sealing station 7 a nozzle is introduced through the openings formed between the sealed discrete points, forming the vacuum through said nozzles. The nozzles are then retracted. By providing aeration from the top mold and forming the vacuum from the bottom mold, the second film 31 is sealed along the entire contact surface of the first film 30 due to the compatibility of said films 30 and 31 and the prior heating of the second film 31 in the top mold 8.

In addition, the machine 1 comprises cutting means adapted for longitudinally and/or transversely cutting the films 30, 31, separating the formed packages 34 in the sealing station 7.

In the embodiment shown in the drawing, the cutting means comprise longitudinal blades 16 coupled to the second fixed support 29 of the displacement means 40. Said longitudinal blades 16 longitudinally cut the films 30 and 31, going through the corresponding holes 17. The cutting means further comprises transverse blades coupled to the frame 50 of the machine 1, adapted for transversely cutting the films 30 and 31, going through the holes 17 and/or the notches 18 and separating the packages 34. In other embodiments, the transverse blades and longitudinal blades are arranged in the second fixed support 22 of the displacement means 20.

Although the described embodiments relate to skin packaging methods and machines, the previous description can be applied to a vacuum or modified atmosphere packaging machine and method with the exception of that corresponding to the sealing station. In a modified atmosphere package manufacturing machine, the sealing station comprises a top mold, a bottom mold, sealing means for sealing the second film 31 to the first film 30, particularly around the borders 35 of the package 34, evacuation means for evacuating gases from the package 34 that may exist and filling means introducing the desired gas or gases in the package 34. Such sealing stations are known in the state of the art, so they will not be described in detail. Once the first film 30 and the second film 31 are introduced in the sealing station, evacuation is performed and gases are injected through the filling means, through the holes 17 made by the punching means 15, the second film 31 being sealed to the first film 30 along the non-formed areas 33. In order to assure that the second film 31 does not block said holes 17 during the evacuation operation and while the gas or gases are being introduced, the sealing station 7 comprises a tool or nozzle introduced through the hole 17 to allow evacuating and introducing gas.

If a single package 34 is manufactured, a leak-tight cavity in which the films 30 and 31 are placed is formed, taking into account that the molds do not close against the non-formed area 33, the vacuum means cause the second film 31 to swell up, generating a gap between both films 30 and 31 where nozzles through which gas is injected are introduced. The nozzles are then retracted and both films 30 and 31 are sealed to one another along the non-formed area 33.

In one embodiment of the manufacturing method in which the punching means 15 only makes notches 18 on the edges of the first film 30, the second film 31 is sealed to the first film 30 longitudinally at discrete points in the pre-sealing station 52. Then in the sealing station, nozzles are introduced through the openings formed between the sealed discrete points, performing evacuation and filling through said nozzles. Said nozzles are then retracted, both films 30 and 31 being sealed to one another. Then in the cutting step, the corners 35*b* of the borders 35 of the package 34 are rounded.

The previous description relating to a modified atmosphere packaging machine can be applied to a vacuum packaging machine, with the difference that the process of filling the package with gas after forming the vacuum is not performed.

The machine 1 is adapted for making one or more packages arranged in parallel and one or more series of packages in parallel in each operating mode, such that the machine can be readily adapted to different configurations of packages to be formed.

What is claimed is:

1. A packaging machine configured to operate intermittently between an operating mode and a displacement mode, the packaging machine configured to produce individual sealed packages containing a product, the package machine comprising:

a first film feed assembly configured to feed a first film to the packaging machine;

a thermoforming machine configured to produce from the first film a plurality of side-by-side containers, each of the containers including non-formed areas that continue to exists through the production of the individual sealed packages;

a second film feed assembly configured to feed a second film to the packaging machine, the second film feed assembly located downstream the first film feed assembly, a sealing station that is configured to receive the plurality of containers, the sealing station configured to seal the second film to the non-formed areas of the containers to obtain a plurality of sealed packages;

a punch configured to produce one or more holes and/or notches in the non-formed areas of the containers, the punch being located between the thermoforming station and the sealing station so that air may be evacuated from the containers through the one or more holes and/or notches inside the sealing station;

a cutting station located downstream the sealing station, the cutting station comprising a plurality of cutting blades that are configured to separate the plurality of sealed packages into individual sealed packages by a cutting of the non-formed areas through the one or more holes and/or notches; and a first displacement assembly located downstream of the sealing station and upstream the cutting station, the first displacement assembly configured to move the plurality of sealed packages in the downstream direction toward the cutting station when the packaging machine is in displacement mode, the first displacement assembly including a moveable support and a fixed support that is spaced apart from the moveable support and located downstream the moveable support, the moveable support configured to move back-and-forth in a straight line between a first position and a second position on a stationary elongate guide extending between the moveable support and fixed support, the second position being located downstream the first position and being located nearer the fixed support than the first position, the moveable support supporting one or more hold-down plates that are configured to press against only the non-formed areas of the containers and linearly move the plurality of sealed packages downstream away from the sealing station from an initial position to an end position when the moveable support is linearly moved from the first position to the second position, the initial position and the end position respectively corresponding to the first and second positions of the moveable support, the one or more hold-down plates of the moveable support being configured to not press against the non-formed areas of the containers and linearly return with the moveable support to the first position upon the plurality of sealed packages having been placed in the end position, the one or more hold-down plates of the moveable support being moveable between a first vertical position in which the one or more hold-down plates do not press against the non-formed areas of the containers, and a second vertical position in which the one or more hold-down plates of the moveable support press against the non-formed areas of the containers.

2. The packaging machine according to claim 1, wherein the packaging machine is in the operating mode when the sealing station operates to seal the second film to the non-formed areas of the containers to obtain the plurality of sealed packages.

3. The packaging machine according to claim 2, wherein the the fixed support is stationary in relation to the moveable support, the fixed support supporting one or more hold-down plates that are moveable between a first vertical position and a second vertical position, in the first vertical position the one or more hold-down plates of the fixed support are configured to press against only the non-formed areas of the containers to hold the plurality of sealed packages in the end position, in the second vertical position the one or more hold-down plates of the fixed support are configured not to press against the non-formed areas of the containers, when the packaging machine is in the operating mode the one or more hold-down plates of the fixed support are configured to assume the first vertical position, when the packaging machine is in the displacement mode the one or more hold-down plates of the fixed support are configured to assume the second vertical position.

4. The packaging machine according to claim 3, wherein the moveable support of the first displacement assembly comprises a support surface located below the one or more hold-down plates of the moveable support, the support surface being configured to support the non-formed area of containers, and wherein the support surface moves in unison with the movement of the moveable support.

5. The packaging machine according to claim 3, wherein the fixed support of the first displacement assembly comprises a support surface located below the hold-down plate of the fixed support, the support surface being configured to support the non-formed areas of containers.

6. The packaging machine according to claim 1, wherein geometry of the one or more holes is such that rounded corners are formed on a border of the individual sealed packages produced in the cutting station.

7. The packaging machine according to claim 1, wherein the sealing station includes a top mold and a bottom mold that when pressed one against the other causes a sealing of the second film with the non-formed areas of the containers, when the plurality of containers are positioned in the sealing station the top mold is configured to be situated above the plurality of containers and the bottom mold is configured to be situated below the plurality of containers.

8. The packaging machine according to claim 1, further comprising a pre-sealing station upstream the sealing station that is configured to induce a sealing of the first and second films at discrete points so that gaps exist between the discrete points.

9. The packaging machine according to claim 1, further comprising a second displacement assembly located downstream the first film assembly and upstream the sealing station, the second displacement assembly configured to move the plurality of side-by-side containers in a downstream direction toward the sealing station when the packaging machine is in the displacement mode, the second displacement assembly including a moveable support and a fixed support that is spaced apart from the moveable support, the moveable support of the second displacement assembly configured to move back-and-forth in a straight line between a first position and a second position on a stationary elongate guide extending between the moveable support and fixed support of the second displacement assembly, the second position being located downstream the first position and being located farther from the fixed support of the second displacement assembly than the first position, the moveable support of the second displacement assembly supporting one or more hold-down plates that are configured to press against only the non-formed areas of the side-by-side containers and linearly move the plurality of side-by-side containers downstream away from the first film feed assembly when the moveable support of the second displacement assembly is linearly moved from the first position to the second position, the one or more hold-down plates of the moveable support of the second displacement assembly being configured to not press against the non-formed areas of the side-by-side containers and linearly return with the moveable support to the first position after the moveable support is moved to the second position, the one or more hold-down plates of the moveable support of the second displacement assembly being moveable between a first vertical position in which the one or more hold-down plates do not press against the non-formed areas of the side-by-side containers, and a second vertical position in which the one or more hold-down plates of the moveable support press against the non-formed areas of the side-by-side containers.

10. The packaging machine according to claim 1, wherein the one or more hold-down plates of the moveable support have a length substantially equal to a distance between the first and second positions of the moveable support.

* * * * *